US006733310B2

(12) United States Patent
Fujikura et al.

(10) Patent No.: US 6,733,310 B2
(45) Date of Patent: May 11, 2004

(54) ELECTRICAL CONNECTOR WITH IMPROVED ELECTROSTATIC DISCHARGE SYSTEM

(75) Inventors: Mitsuo Fujikura, Sagamihara (JP); Kazushige Asakawa, Yokohama (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/303,132

(22) Filed: Nov. 22, 2002

(65) Prior Publication Data

US 2003/0100207 A1 May 29, 2003

(30) Foreign Application Priority Data

Nov. 27, 2001 (JP) ..... 2001-360198

(51) Int. Cl.[7] ..... H01R 4/66
(52) U.S. Cl. ..... 439/95; 439/181
(58) Field of Search ..... 439/95, 181, 96, 439/2, 607–610, 92

(56) References Cited

U.S. PATENT DOCUMENTS

| | | | | | |
|---|---|---|---|---|---|
| 3,587,029 | A | | 6/1971 | Knowles | 339/14 |
| 4,268,102 | A | | 5/1981 | Grabbe | 339/75 |
| 4,341,433 | A | | 7/1982 | Cherian et al. | 339/176 |
| 4,773,877 | A | | 9/1988 | Krüger et al. | 439/482 |
| 4,828,503 | A | | 5/1989 | Gilissen et al. | 439/62 |
| 4,906,194 | A | | 3/1990 | Grabbe | 439/71 |
| 4,995,817 | A | | 2/1991 | Grabbe | 439/71 |
| 4,998,886 | A | | 3/1991 | Werner | 439/66 |
| 5,107,071 | A | | 4/1992 | Nakagawa | 174/35 |
| 5,151,054 | A | | 9/1992 | Briones et al. | 439/620 |
| 5,152,694 | A | | 10/1992 | Bargain | 439/66 |
| 5,240,424 | A | * | 8/1993 | Honma et al. | 439/95 |
| 5,308,252 | A | | 5/1994 | Mroczkowski et al. | 439/66 |
| 5,513,996 | A | | 5/1996 | Annerino et al. | 439/95 |
| 5,540,599 | A | | 7/1996 | Bishop | 439/289 |
| 5,567,169 | A | * | 10/1996 | McCleerey et al. | 439/181 |
| 5,603,620 | A | | 2/1997 | Hinze et al. | 439/95 |
| 5,618,196 | A | * | 4/1997 | Biswas | 439/181 |
| 5,667,411 | A | | 9/1997 | O'Sullivan | 439/701 |
| 5,704,810 | A | | 1/1998 | Shimasaki | 439/620 |
| 5,772,449 | A | | 6/1998 | Feldmeier et al. | 439/66 |
| 5,975,955 | A | | 11/1999 | Bogiel et al. | 439/607 |
| 6,048,228 | A | | 4/2000 | Aso | 439/660 |
| 6,074,223 | A | * | 6/2000 | Huang | 439/95 |
| 6,093,058 | A | | 7/2000 | Wu | 439/607 |
| 6,150,606 | A | | 11/2000 | Matsumoto et al. | 174/35 |
| 6,193,555 | B1 | | 2/2001 | Chang | 439/608 |
| 6,234,841 | B1 | | 5/2001 | Chang et al. | 439/609 |
| 6,254,403 | B1 | | 7/2001 | Bernardini | 439/95 |
| 6,290,524 | B1 | | 9/2001 | Simmel | 439/289 |
| 6,312,295 | B2 | | 11/2001 | Nishimatsu | 439/700 |
| 6,358,097 | B1 | | 3/2002 | Peters | 439/700 |
| 6,361,365 | B1 | * | 3/2002 | Yu | 439/95 |
| 6,468,097 | B1 | * | 10/2002 | Bernstein et al. | 439/181 |

* cited by examiner

*Primary Examiner*—Gary Paumen
(74) *Attorney, Agent, or Firm*—Stephen Z. Weiss

(57) ABSTRACT

An electrical connector includes a dielectric housing, with a plurality of conductive terminals mounted in the housing. At least one of the terminals is a ground terminal. A metal shield is mounted on the housing. An intermediate conductive terminal is mounted on the housing and includes one end engaging the metal shield and an opposite end engaging the ground terminal.

18 Claims, 3 Drawing Sheets

ELECTRICAL CONNECTOR WITH IMPROVED ELECTROSTATIC DISCHARGE SYSTEM

FIELD OF THE INVENTION

This invention generally relates to the art of electrical connectors and, particularly, to an electrostatic discharge system for electrical connectors.

BACKGROUND OF THE INVENTION

An electrical connector often has a mating end at which conductive terminals are exposed for engagement with the terminals of a complementary mating connector. For instance, the connector may include a receptacle within which contact portions of the terminals are exposed for engagement with the terminals of a complementary plug connector. If an individual touches one or more contact portions of the terminals, as with the person's finger, an electrostatic charge may be created and discharged through the terminals and damage may result to interior components with which the connector is electrically coupled.

In order to avoid such problems with electrostatic charges, various types of means have been proposed, such as mounting shutter plates at the mating ends of connectors to prevent accidental engagement with the contact portions of the terminals. In addition, Japanese Patent Laid-Open No. 11-259617 discloses a plate-like conductive member mounted at the mating end of an electrical connector and connected to a metal cover so that an electrostatic charge, if any, is discharged by the conductive member to the metal cover.

Electronic components, such as integrated circuits for a portable information terminal set, are usually mounted on printed circuit boards or flat flexible cables which, in turn, are disposed in a connection end of an electrical connector that is installed in the terminal set. However, efforts have not been successful in providing electrostatic discharge prevention means for the electrical connector and the printed circuit board or flat flexible cable. Accordingly, when connecting or disconnecting the electrical connector or the printed circuit board or flat flexible cable, electrostatic charges may cause damage to the electronic components such as the integrated circuits. Any efforts have involved grounding shields which are soldered directly to the printed circuit board or the shield has an integrated terminal arm engageable with the printed circuit. The use of solder is not always the best choice since solder is an additional process which adds to the cost of manufacture. In addition, because soldering processes require heat, which can damage nearby components, the soldering process must be highly controlled to avoid damage. Manufacturing a shield with an integral terminal arm having a consistent contact pressure on a flexible printed circuit also is very difficult to manufacture. The present invention is directed to solving these problems in a solderless electrostatic discharge system for such connectors.

SUMMARY OF THE INVENTION

An object, therefore, of the invention is to provide an electrical connector with a new and improved electrostatic discharge system.

In the exemplary embodiment of the invention, an electrical connector includes a dielectric housing having a connector mating face and a circuit board receiving face. A plurality of conductive terminals are mounted in the housing. Each terminal includes a contact end generally at the connector mating face of the housing and a board-engaging end generally at the circuit board receiving face of the housing. At least one of the terminals is a ground terminal. A metal shield is mounted on the housing about at least the connector mating face thereof. An intermediate conductive terminal is mounted on the housing and includes one end engaging the metal shield and an opposite end engaging the ground terminal.

As disclosed herein, one end of the intermediate terminal abuts against an inner surface of the metal shield. An opposite end of the intermediate terminal abuts the ground terminal. Solder connections are completely avoided.

According to one aspect of the invention, the intermediate terminal includes a resilient portion between its opposite ends to provide a contact pressure with the metal shield and the ground terminal. In the exemplary embodiment, the resilient portion is generally S-shaped. The intermediate terminal may be stamped and formed of conductive sheet metal material, with the S-shaped resilient portion being generally planar. The opposite ends of the intermediate terminal are formed to extend out of the plane of the S-shaped resilient portion.

According to another aspect of the invention, the intermediate terminal is disposed for free movement within a groove in the housing. The resilient portion of the terminal is located substantially in the groove. The opposite ends of the intermediate terminal are exposed at opposite ends of the groove for engaging the metal shield and the ground terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

Figure 1:
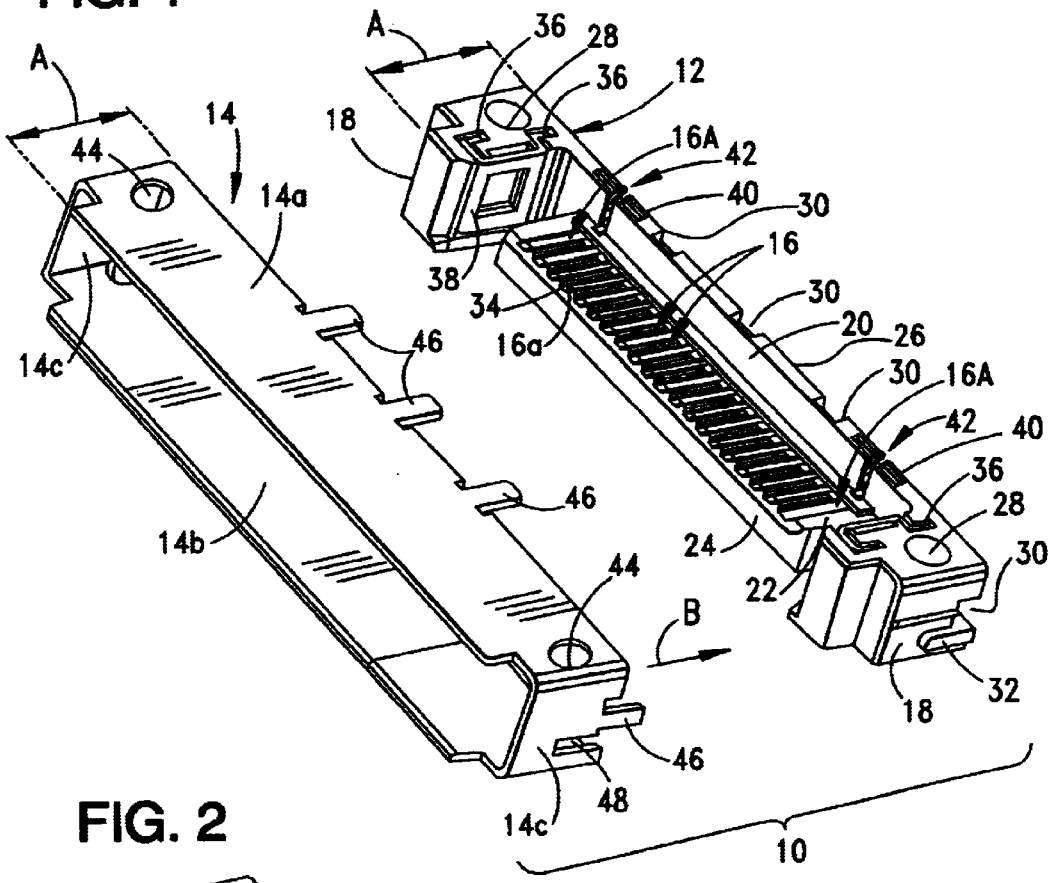
FIG. 1 is an exploded perspective view of an electrical connector according to the invention.

DETAILED DESCRIPTION OF THE PREFERRED EMBODIMENT:

Referring to the drawings in greater detail, and first to FIG. 1, the invention is embodied in an electrical connector 10 which includes an elongated dielectric housing, generally designated 12, a metal shell or shield, generally designated 14, and a plurality of conductive terminals, generally designated 16, mounted on the housing. The terminals are spaced at regular intervals longitudinally of the housing, and a pair of opposite end terminals 16A are ground terminals.

Dielectric housing 12 of connector 10 is molded of plastic material in a generally U-shape formed by right and left side walls 18 and an elongated rear wall 20 extending therebetween. An elongated mating portion 22 projects forwardly from the rear wall. The mating portion generally defines a front mating face 24 of the connector, and rear wall 20 generally defines a rear circuit board receiving face 26 of the connector. Mounting holes 28 extend downwardly through side walls 28 of the housing. A plurality of notches 30 are formed in rear face 26 for facilitating mounting shield 14 to the housing, as will be seen hereinafter. A rib 32 projects outwardly from each side wall 18, again for facilitating mounting the shield to the housing. The top surface of mating portion 22 has a plurality of spaced grooves 34 for receiving flat contact portions 16*a* of terminals 16 (and 16A). End walls 18 include latch grooves 36 for receiving a metal latch 18 which facilitates latching a mating connector (FIG. 6) to connector 10. Finally, the top edge of rear wall 20 includes a pair of grooves 40 for receiving a pair of intermediate terminals, generally designated 42 and described hereinafter.

Still referring to FIG. 1, shield 14 is a metal shell stamped and formed of conductive sheet metal material. The shield is in the form of an elongated, hollow shroud defined by a top wall 14*a*, a bottom wall 14*b* and side walls 14*c*. The top wall has a pair of mounting holes 44 which align with mounting holes 28 of housing 12 when the shield is mounted on the housing. A plurality of securing tabs 46 project rearwardly of the shield in alignment with notches 30 at the rear of the housing. A groove 48 in each end wall 14*c* is alignable with ribs 32 at opposite ends of the housing. The width of the shield is generally the same as the width of housing 12 as defined by end walls 18 of the housing, as indicated by double-headed arrows "A" in FIG. 1.

Figure 2:
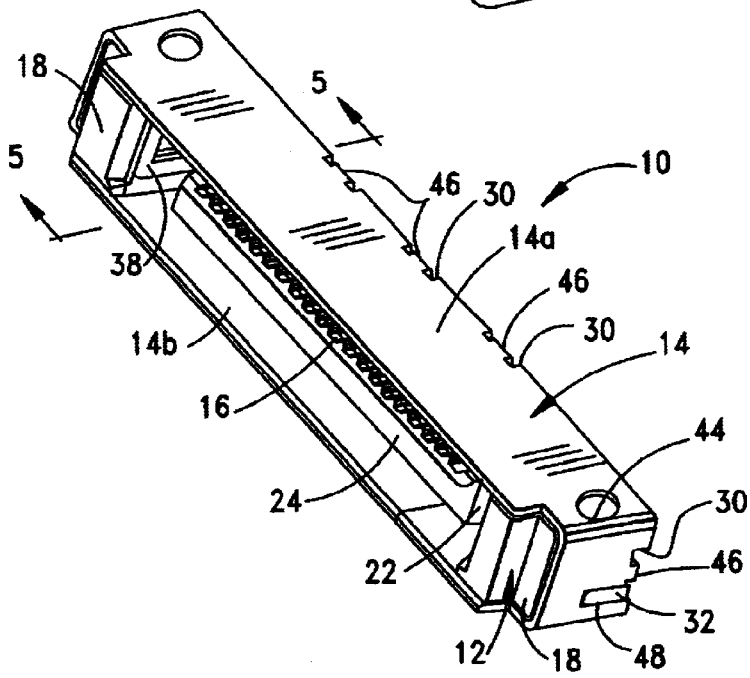
FIG. 2 is a perspective view of the electrical connector of FIG. 1, in assembled condition.

FIG. 2 shows shield 14 mounted to housing 12. In essence, the shield is mounted to the housing in the direction of arrow "B" (FIG. 1) aligning ribs 32 on the housing with grooves 48 at opposite ends of the shield. When the ribs bottom-out in the grooves, securing tabs 46 of the shield project rearwardly beyond rear face 40 of the housing. All of the securing tabs then are bent inwardly into notches 30 at the rear of the housing to hold the shield mounted about the housing as seen in FIG. 2. The shield completely surrounds mating portion 22 and mating face 24 of the housing.

Figure 3:
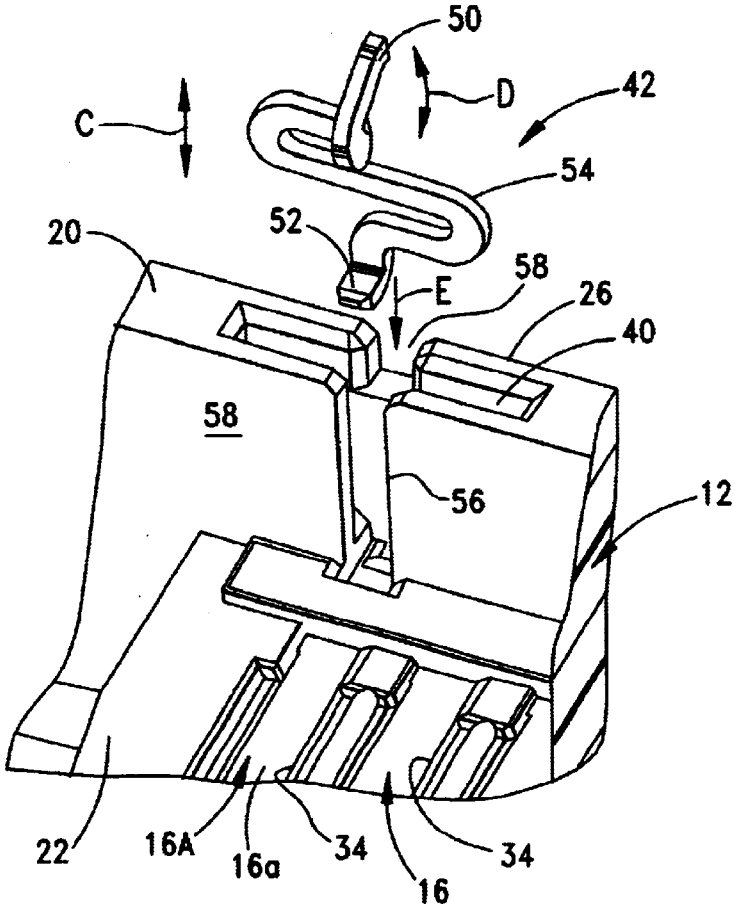
FIG. 3 is an enlarged, fragmented perspective view of one of the intermediate terminals removed from its groove in the connector housing.

FIG. 3 shows one of the intermediate terminals 42 which is positionable into one of the grooves 40 in the top edge of rear wall 20 of connector housing 12. Each intermediate terminal 42 is stamped and formed of conductive sheet metal material and includes a top end or tab 50, a bottom end or tab 52 and an S-shaped resilient portion 54 joining the opposite ends 50 and 52. The S-shaped resilient portion is generally planar (i.e., in the plane of the sheet metal material from which the terminal is stamped and formed), and top and bottom ends 50 and 52 are formed to extend out of the plane of the S-shaped resilient portion as clearly seen in FIG. 3. This configuration of the intermediate terminal provides resiliency for the terminal in the direction of double-headed arrow "C", with top end or tab 50 movable in the direction of double-headed arrow "D". The intermediate terminal is mounted into groove 40 in the direction of arrow "E", as bottom end or tab 52 moves into a guide groove 56 in a front face 58 of rear wall 20 of connector housing 12. Top end or tab 50 of the intermediate terminal moves into a notch 58 at the rear top edge of the rear wall. The mounted position of the intermediate terminal is shown in FIG. 4.

Figure 4:
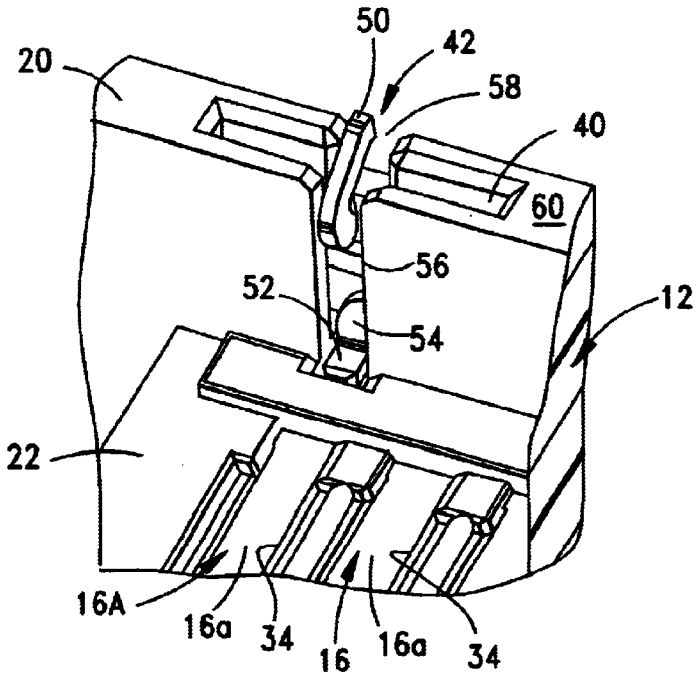
FIG. 4 is a view similar to that of FIG. 3, with the intermediate terminal mounted in the groove.

Referring specifically to FIG. 4, when intermediate terminals 42 are fully mounted downwardly into grooves 40 in connector housing 12, bottom ends or tabs 52 of the terminals abut against flat contact portions 16*a* of ground terminals 16A. Top ends or tabs 50 of the intermediate terminals, while being in alignment with notches 58 in the housing, project upwardly from a top edge 60 of rear wall 20 as seen in FIG. 4, whereby the top ends of the intermediate terminals are engageable with shield 14 when the shield is mounted to the housing, as described below.

Figures 5, 6:
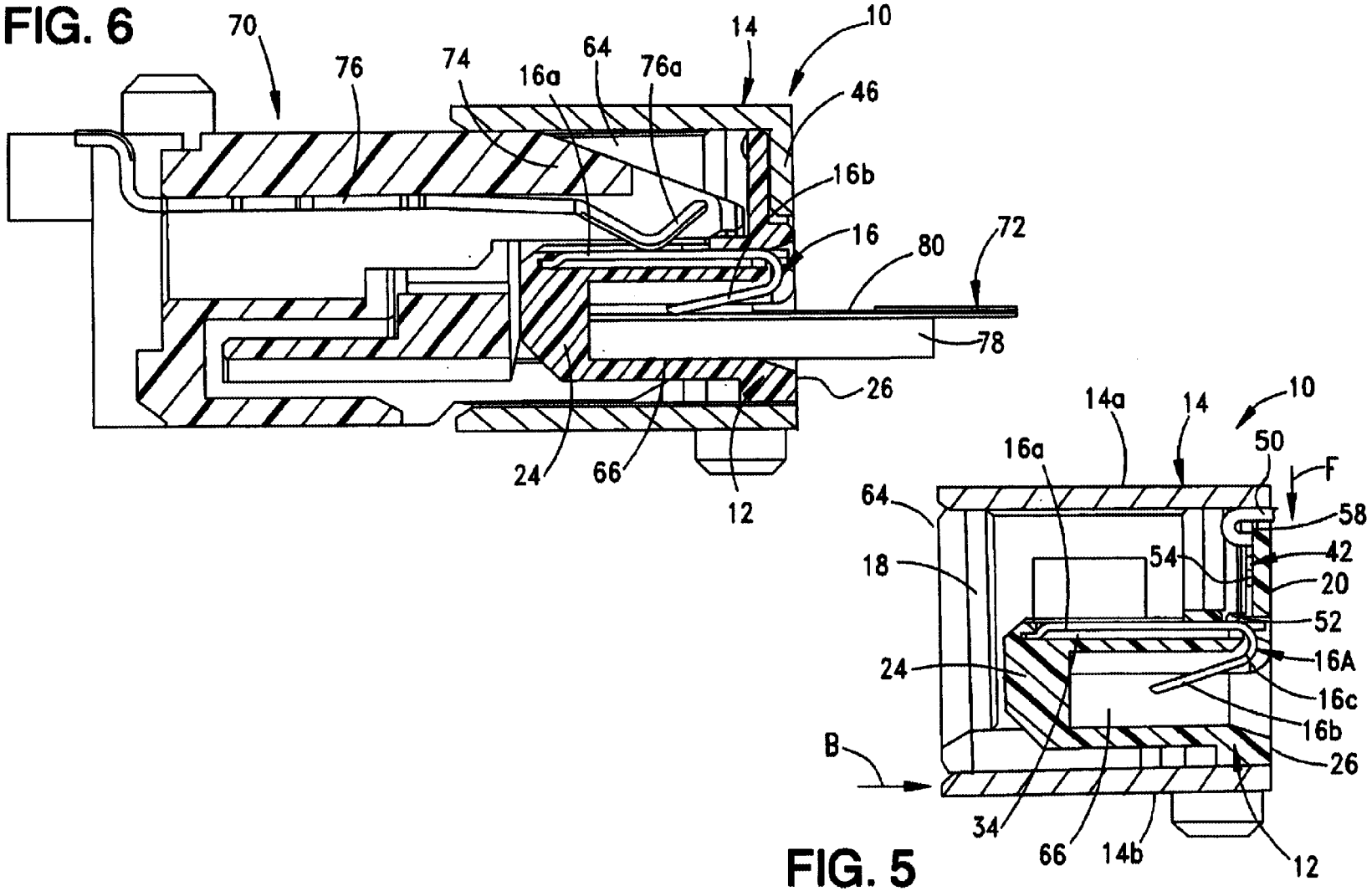
FIG. 5 is an enlarged vertical section taken generally along line 5—5 of FIG. 2.
FIG. 6 is a view somewhat similar to FIG. 5, with the connector receiving a printed circuit board and mated to a complementary mating connector.

FIG. 5 shows shield 14 mounted to connector housing 12 in the direction of arrow "B". When the shield is slidably mounted to the housing, the shield engages the top ends 50 of intermediate terminals 42 and biases the top ends downwardly in the direction of arrow "F", facilitated by the resiliency of resilient portions 54 of the intermediate terminals. Therefore, when the shield is fully mounted to the connector housing, the resilient portions of the intermediate terminals exert pressure in opposite directions to bias top ends or tabs 50 of the terminals against the inside of shield 14, and bias the bottom ends or tabs 52 of the terminals against the top of contact portions 16*a* of ground terminals 16A. This interengaging system avoids any solder connections.

Still referring to FIG. 5, each ground terminal 16A is generally U-shaped to define contact portion 16*a* and a second contact portion 16*b*. The contact portions are joined by a bend 16*c* of the U-shaped configuration. The remaining terminals 16, other than ground terminals 16A, are of the same configuration. Contact portions 16*a* are flat and are disposed in grooves 34 in the top surface of mating portion 24 of the housing. These contact portions 16*a*, thereby, are exposed within a connector recess or receptacle 64 defined by shield 14 and the top of mating portion 24 of the connector housing. Contact portions 16*b* of the U-shaped terminals project angularly downwardly into a circuit board receiving recess or receptacle 66 at the rear of the connector housing and extending into the rear of mating portion 24 thereof, as seen in FIG. 5.

FIG. 6 shows a complementary mating connector, generally designated 70, and a flexible printed circuit board, generally designated 72, mated with connector 10. Mating connector 70 includes a plug portion 74 inserted into connector recess 64 of connector 10. Terminals 76 have contact portions 76*a* for engaging contact portions 16*a* of terminals 16 (and 16A). Flexible circuit board 72 is disposed on top of a rigid carrier 78 for biasing conductors 80 of the circuit board against contact portions 16*b* of terminals 16 within circuit board receiving recess 66 of connector housing 12. The contact portions 16*b* of ground terminals 16A engage ground circuit traces or conductors 80 on circuit board 72.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a dielectric housing having a connector mating face and a circuit board receiving face;

a plurality of conductive terminals mounted in the housing, each terminal including a contact end generally at the connector mating face of the housing and a board-engaging end generally at the circuit board receiving face of the housing and at least one of the terminals being a ground terminal;

a metal shield mounted on the housing about at least the connector mating face thereof; and an intermediate conductive terminal mounted on the housing and including one end engaging the metal shield and an opposite end engaging the ground terminal.

2. The electrical connector of claim 1 wherein said one end of the intermediate terminal abuts against an inner surface of the metal shield and said opposite end of the intermediate terminal abuts the ground terminal.

3. The electrical connector of claim 2 wherein said intermediate terminal is stamped and formed from conductive sheet metal material with its opposite ends formed for surface abutting the metal shield and the ground terminal.

4. The electrical connector of claim 1 wherein said intermediate terminal includes a resilient portion between its opposite ends to provide a contact pressure with the metal shield and the ground terminal.

5. The electrical connector of claim 4 wherein said resilient portion is generally S-shaped.

6. The electrical connector of claim 5 wherein said intermediate terminal is stamped and formed of conductive sheet metal material with said S-shaped resilient portion being generally planar and with the opposite ends of the intermediate terminal being formed to extend out of the plane of the S-shaped resilient portion.

7. The electrical connector of claim 1 wherein said intermediate terminal is disposed for free movement within a groove in the housing.

8. The electrical connector of claim 7 wherein said intermediate terminal includes a resilient portion between its opposite ends to provide a contact pressure with the metal shield and the ground terminal, said resilient portion being located substantially in said groove, and the opposite ends of the intermediate terminal being exposed at opposite ends of the groove for engaging the metal shield and the ground terminal.

9. An electrical connector, comprising:

a dielectric housing having a connector mating face with a connector receptacle for receiving a complementary mating connector having mating terminals, and a circuit board receiving face having a board receptacle for receiving a printed circuit board having conductors thereon;

a plurality of conductive terminals mounted in the housing, each terminal including a contact end exposed in said connector receptacle and a board-engaging end exposed in said board receptacle, and at least one of the terminals being a ground terminal with its board-engaging end engaging a ground circuit of the printed circuit board;

a metal shield mounted on the housing about at least the connector mating face thereof; and an intermediate conductive terminal disposed for free movement within a groove in the housing, the intermediate terminal including one end abutting an inner surface of the metal shield, an opposite end abutting the ground terminal and a resilient portion between said opposite ends to provide a contact pressure with the metal shield and the ground terminal, the resilient portion being located substantially within said groove in the housing, and the opposite ends of the intermediate terminal being exposed at opposite ends of the groove for engaging the metal shield and the ground terminal.

10. The electrical connector of claim 9 wherein said resilient portion of the intermediate terminal is generally S-shaped.

11. The electrical connector of claim 10 wherein said intermediate terminal is stamped and formed of conductive sheet metal material with said S-shaped resilient portion being generally planar and with the opposite ends of the intermediate terminal being formed to extend out of the plane of the S-shaped resilient portion.

12. An electrical connector, comprising:

a dielectric housing;

a plurality of conductive terminals mounted in the housing, at least one of the terminals being a ground terminal;

a metal shield mounted on the housing; and an intermediate conductive terminal mounted on the housing and including one end engaging the metal shield, an opposite end engaging the ground terminal, and a resilient portion between the ends to provide a contact pressure with the metal shield and the ground terminal, the resilient portion being generally S-shaped.

13. The electrical connector of claim 12 wherein said one end of the intermediate terminal abuts against an inner surface of the metal shield and said opposite end of the intermediate terminal abuts the ground terminal.

14. The electrical connector of claim 13 wherein said intermediate terminal is stamped and formed from conductive sheet metal material with its opposite ends formed for surface abutting the metal shield and the ground terminal.

15. The electrical connector of claim 12 wherein said intermediate terminal stamped and formed of conductive sheet metal material with said S-shaped resilient portion being generally planar and with the opposite ends of the intermediate terminal being formed to extend out of the plane of the S-shaped resilient portion.

16. The electrical connector of claim 12 wherein said intermediate terminal is disposed for free movement within a groove in the housing.

17. The electrical connector of claim 16 wherein said intermediate terminal includes a resilient portion between its opposite ends to provide a contact pressure with the metal shield and the ground terminal, said resilient portion being located substantially in said groove, and the opposite ends of the intermediate terminal being exposed at opposite ends of the groove for engaging the metal shield and the ground terminal.

18. An electrical connector, comprising:

a dielectric housing;

a plurality of conductive terminals mounted in the housing, at least one of the terminals being a ground terminal;

a metal shield mounted on the housing; and an intermediate conductive terminal mounted on the housing and including a resilient portion between two ends of the terminal, one end engaging the metal shield and an opposite end engaging the ground terminal, the resilient portion providing a contact pressure between the metal shield and the ground terminal.

* * * * *